US006095765A

United States Patent [19]

Khalifa

[11] Patent Number: 6,095,765

[45] Date of Patent: Aug. 1, 2000

[54] COMBINED PRESSURE RATIO AND PRESSURE DIFFERENTIAL RELIEF VALVE

[75] Inventor: Hussein E. Khalifa, Manlius, N.Y.

[73] Assignee: Carrier Corporation, Farmington, Conn.

[21] Appl. No.: 09/035,189

[22] Filed: Mar. 5, 1998

[51] Int. Cl.[7] ..... F04B 49/00

[52] U.S. Cl. ..... 417/310; 417/308; 417/307; 418/55.1

[58] Field of Search ..... 417/301, 307, 417/308, 310; 418/55.1

[56] References Cited

U.S. PATENT DOCUMENTS

| | | | |
|---|---|---|---|
| Re. 35,216 | 4/1996 | Anderson et al. | 417/310 |
| 4,497,615 | 2/1985 | Griffith | 417/310 |
| 4,560,330 | 12/1985 | Murayama et al. | 418/55 |
| 4,840,845 | 6/1989 | Moilanen | 417/301 |
| 4,904,164 | 2/1990 | Mabe et al. | 417/308 |
| 5,169,294 | 12/1992 | Barito | 417/310 |
| 5,362,210 | 11/1994 | Richardson | 417/307 |
| 5,527,158 | 6/1996 | Ramsey et al. | 417/32 |
| 5,713,726 | 2/1998 | Nakayoshi | 417/310 |
| 5,803,716 | 9/1998 | Wallis et al. | 417/310 |
| 5,860,791 | 1/1999 | Kikuchi | 417/310 |

FOREIGN PATENT DOCUMENTS

| | | |
|---|---|---|
| 0 681 105 A2 | 11/1995 | European Pat. Off. . |
| 07 27061 | 1/1995 | Japan . |

*Primary Examiner*—Teresa Walberg
*Assistant Examiner*—Leonid Fastovsky
*Attorney, Agent, or Firm*—Banner & Witcoff, Ltd.

[57] ABSTRACT

A pressure relief device has a chamber formed in a fixed scroll of a scroll-type machine, such as a scroll compressor. A piston is housed within the chamber releasably sealingly engaging a first passage which exposes the chamber to a discharge port formed in the fixed scroll. A second passage exposes the chamber to a suction plenum. A third passage exposes the chamber to pockets formed by the fixed and orbiting scrolls of the scroll compressor. In certain preferred embodiments, a pressure relief valve having a stem and a head is housed within a cavity formed in the piston. The head is biased by a spring into releasable sealing engagement with an aperture formed in the piston. The pressure relief valve passes fluid to the suction plenum whenever the difference between a discharge pressure and a suction pressure exceeds a predetermined value. The piston passes fluid to the suction plenum whenever the ratio of discharge pressure to suction pressure exceeds a predetermined value.

30 Claims, 2 Drawing Sheets

COMBINED PRESSURE RATIO AND PRESSURE DIFFERENTIAL RELIEF VALVE

INTRODUCTION

The present invention is directed to compressors, and, more particularly, to improved relief valves for compressors.

BACKGROUND

Scroll machines, such as scroll compressors using a fixed scroll and an orbiting scroll, are well known in the industry. Each of the scrolls of a scroll compressor has a spiral wrap extending axially from a base plate. The spiral wraps nest with one another to form pockets of varying volume. A fluid introduced into a low pressure area of the pockets is compressed by the cooperating movement of the spiral wraps, and discharged from a high pressure area proximate the center of the wraps. A motor drives a crankshaft which in turn drives the orbiting scroll along its orbital path. A rotation prevention mechanism, such as an Oldham coupling, is used to prevent rotation of the orbiting scroll as it undergoes such orbital motion.

Scroll-type compressors, as well as other types of scroll machines, may experience high pressure differential loads which can exceed their design capabilities and lead to failures unless protected by a suitable pressure relieving device. Scroll machines need to be protected against high pressure ratio conditions as well. High pressure ratio conditions may occur during loss of charge and result in a high temperature rise in the compressor pump. This in turn may cause a range of failure modes, including tip and floor scoring. High pressure ratios can also induce a wobble instability in the orbiting scroll, which could lead to failure.

A pressure ratio limiting device for a scroll machine is shown in U.S. Pat. No. 5,169,294 to Barito. This device operates to pass fluid at discharge pressure back to the suction pressure portion of the scroll housing when the pressure ratio exceeds a predetermined value, but will not prevent the buildup of excessive pressure differential.

U.S. Pat. No. Re 35,216 to Anderson et al. discloses a scroll machine having a valve which passes discharge pressure fluid to the suction pressure portion of the housing when the pressure ratio exceeds a predetermined value. The valve of Anderson et al has seals formed between one of its scrolls and another member of the compressor.

U.S. Pat. No. 5,527,158 to Ramsey et al. discloses a scroll machine having a valve which passes discharge gas when a sensed pressure exceeds a predetermined value. The device of Ramsey et al does not respond to excess pressure differentials or excess pressure ratios.

It is an object of the present invention to provide a pressure relief device which reduces or wholly overcomes some or all of the aforesaid difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide scroll-type machines, such as compressors, having improved pressure relief valves.

In accordance with a first aspect, a scroll-type machine has a housing defining a suction plenum. An orbiting scroll having a spiral wrap is positioned within the housing. A fixed scroll is mounted within the housing, having a spiral wrap nested with the spiral wrap of the orbiting scroll to form moveable crescent-shaped compression pockets between the wraps for progressively compressing fluid from the suction plenum at suction pressure through intermediate pressure to a discharge pressure at a discharge port formed in the fixed scroll. A chamber is formed within the fixed scroll. A first passage is formed in the fixed scroll from the discharge port to the chamber. A second passage is formed in the fixed scroll from the chamber to the suction plenum, and a third passage is formed in the fixed scroll from the chamber to the crescent-shaped compression pockets. A pressure relief device is housed in the chamber in the fixed scroll, sealingly engaging a first surface of the fixed scroll to form a fluid pressure seal within the chamber between the second passage and the third passage, and releasably sealingly engageable to a second surface of the fixed scroll to form a releasable fluid pressure seal within the chamber between the first passage and the second passage.

In accordance with another aspect, a scroll-type machine has a housing defining a suction plenum for containing fluid at a suction pressure. An orbiting scroll is positioned within the housing and has a spiral wrap. A fixed scroll is mounted within the housing, having a spiral wrap nested with the spiral wrap of the orbiting scroll forming pockets therebetween for passing intermediate pressure fluid. The fixed scroll has a discharge port for passing fluid at a discharge pressure and a chamber formed therein. The chamber is exposed to the discharge port, and the suction plenum, and the pockets. A pressure relief device is housed within the chamber in sealing engagement with a first surface of the fixed scroll providing a seal between the pockets and the suction plenum, and in releasable sealing engagement with a second surface of the fixed scroll providing a releasable seal between the discharge port and the suction plenum. The pressure relief device is adapted to pass fluid from the discharge port to the suction plenum when the ratio of the discharge pressure to the suction pressure exceeds a predetermined value.

In accordance with another aspect, a scroll-type machine has a fixed scroll mounted within a housing having a spiral wrap, a chamber formed therein, and a discharge port for passing fluid at a discharge pressure. An orbiting scroll has a spiral wrap nested with the spiral wrap of the fixed scroll forming pockets therebetween for progressively compressing fluid from suction, through intermediate to discharge pressure. A suction plenum is provided for containing fluid at a suction pressure. A pressure relief device is housed within the chamber and is adapted to pass fluid from the discharge port to the suction plenum when a difference between the discharge pressure and the suction pressure exceeds a predetermined value and when the ratio of the discharge pressure to the suction pressure exceeds a predetermined value.

In accordance with another aspect, a compressor has a housing defining a suction plenum. A first scroll member is positioned within the housing. A second scroll member is positioned within the housing and intermeshed with the first scroll member to form moveable crescent-shaped compression pockets between the wraps for progressively compressing fluid from the suction plenum at suction pressure through intermediate pressure to a discharge pressure at a discharge port formed in the first scroll member. A chamber is formed within the first scroll member, and a first passage is formed in the first scroll member from the discharge port to the chamber. A second passage is formed in the first scroll member from the chamber to the suction plenum, and a third passage is formed in the first scroll member from the chamber to the crescent-shaped compression pockets. A pressure relief device is positioned in the chamber in the first scroll member, sealingly engaging a first surface of the first scroll member to form a fluid pressure seal within the chamber between the second passage and the third passage, and releasably sealingly engageable to a second surface of the first scroll member to form a releasable fluid pressure seal within the chamber between the first passage and the second passage. The pressure relief device is adapted to pass fluid from the first passage to the second passage when the ratio of fluid pressure in the first passage to fluid pressure in the second passage exceeds a predetermined value.

In accordance with yet another aspect of the invention, a scroll-type machine has an orbiting scroll contained within a housing and having a spiral wrap. A fixed scroll is mounted within the housing having a spiral wrap nested with the spiral wrap of the orbiting scroll forming pockets therebetween. The fixed scroll has a chamber formed therein, a discharge port, a first passage providing fluid communication between the discharge port and the chamber, a second passage providing fluid communication between a suction plenum and the chamber, and a third passage providing fluid communication between the pockets and the chamber. A pressure relief device is housed within the chamber in sealing engagement with a first surface of the fixed scroll providing a seal between the pockets and the suction plenum, and in sealing engagement with a second surface of the fixed scroll providing a seal between the discharge port and the suction plenum. The pressure relief device is adapted to pass fluid from the discharge port to the suction plenum when the ratio of the discharge pressure to the suction pressure exceeds a predetermined value and to pass fluid from the discharge port to the suction plenum when the difference between the discharge pressure and the suction pressure exceeds a predetermined value.

In accordance with another aspect of the invention, a scroll-type machine has a housing defining a suction plenum. An orbiting scroll is positioned within the housing and has a spiral wrap. A fixed scroll is mounted within the housing and has a spiral wrap nested with the spiral wrap of the orbiting scroll forming pockets therebetween. A chamber is formed in the fixed scroll and is in fluid communication with a discharge port formed in the fixed scroll, the suction plenum, and the pockets. A pressure relief device is housed within the chamber and operates in a radial direction with respect to the scroll-type machine to pass fluid from the discharge port to the suction plenum when the ratio of a discharge pressure to a suction pressure exceeds a predetermined value.

From the foregoing disclosure, it will be readily apparent to those skilled in the art, that is, those who are knowledgeable or experienced in this area of technology, that the present invention provides a significant technological advance. Preferred embodiments of the relief valve of the present invention can provide pressure relief in a simple and efficient manner, and more cost effectively than certain other known relief valves. Such relief valves can advantageously provide relief from both excess pressure differentials and excess pressure ratios. These and additional features and advantages of scroll-type machines having the pressure relief valves disclosed here will be further understood from the following detailed disclosure of certain preferred embodiments.

BRIEF DESCRIPTION OF THE DRAWINGS

Certain preferred embodiments are described in detail below with reference to the appended drawings wherein.

Figure 1:
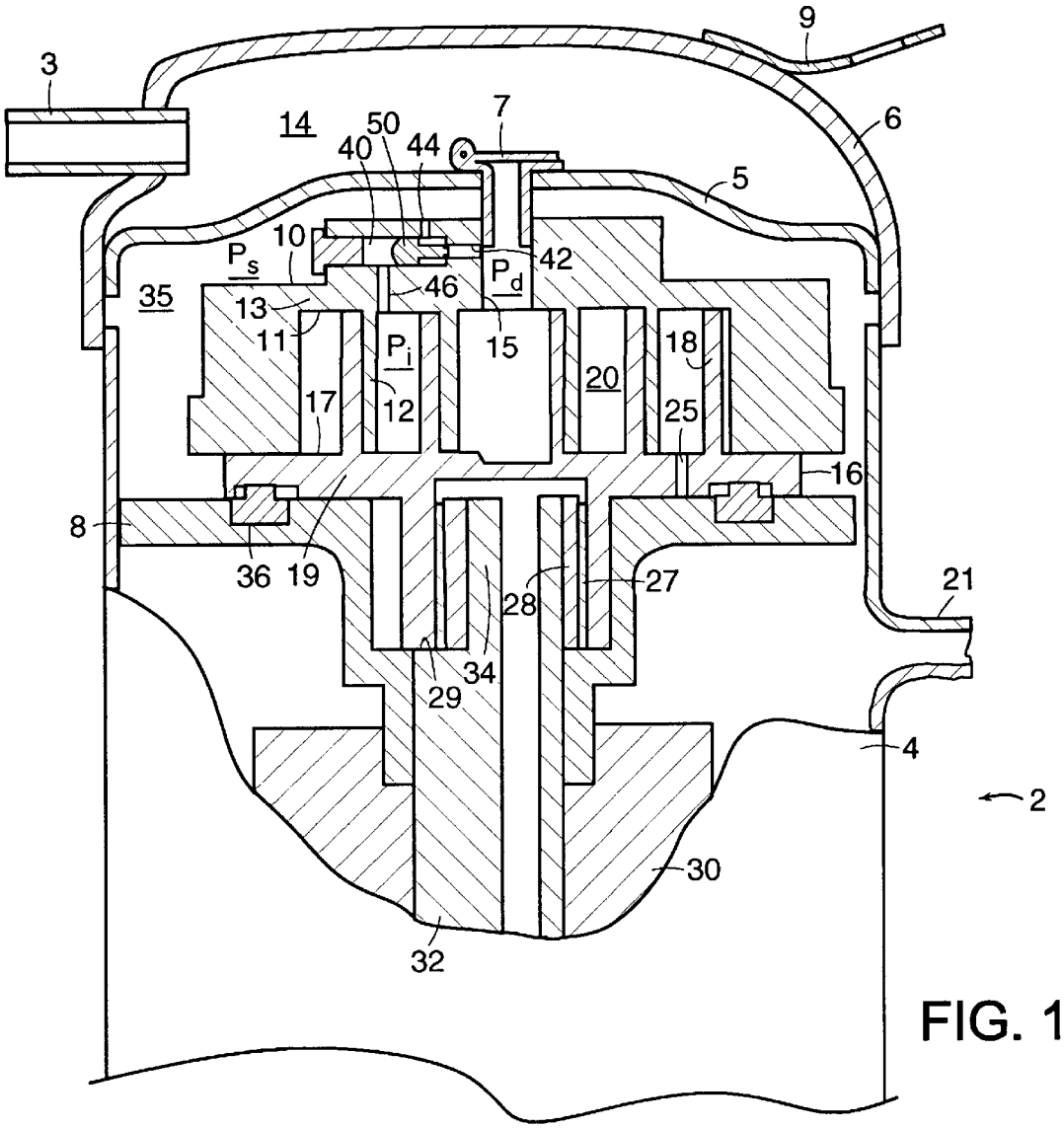
FIG. 1 is a schematic elevation view, shown partially broken away and partially in section, of a scroll-type compressor in accordance with a preferred embodiment of the present invention.

The figures referred to above are not drawn necessarily to scale and should be understood to present a representation of the invention, illustrative of the principles involved. Some features of the combined pressure ratio and pressure differential relief valve depicted in the drawings have been enlarged or distorted relative to others to facilitate explanation and understanding. The same reference numbers are used in the drawings for similar or identical components and features shown in various alternative embodiments.

DETAILED DESCRIPTION OF CERTAIN PREFERRED EMBODIMENTS

Scroll-type machines, which may comprise fixed and orbiting scrolls, are known in the industry for providing various functions. One such scroll-type machine is a scroll compressor, used to compress a fluid, such as refrigerant. Scroll machines in accordance with the invention will have configurations and components determined, in part, by the intended application and environment in which they are used. For purposes of illustration and description, the following discussion will focus on scroll compressors in accordance with certain preferred embodiments. Those skilled in the art will recognize, however, the ready application of the features and principles disclosed here to other scroll-type machines. Also, for convenience, the following discussion will use directional terms such as top or upward and bottom, lower or downward to refer to locations or directions for an upstanding scroll compressor design of the type illustrated in FIG. 1 of the appended drawings, unless otherwise clear from the context or from common usage regarding scroll machines. It is to be appreciated that the present invention is also applicable to scroll-type machines of horizontal and other orientations.

In a first preferred embodiment, as seen in FIG. 1, scroll compressor 2 comprises substantially cylindrical housing or center shell 4, and top shell 6 secured to, preferably welded to, an upper end of center shell 4. Crankcase 8 is secured at its outer edges to the interior surface of center shell 4. Fixed scroll 10, having spiral wrap 12 extending axially downwardly from a lower surface 11 of a base plate 13, is positioned above crankcase 8 and secured thereto by bolts (not shown). In certain preferred embodiments, fixed scroll 10 may be securely mounted within center shell 4 without bolts or other similar fasteners directly connecting fixed scroll 10 to crankcase 8. Orbiting scroll 16, having spiral wrap 18 extending axially upwardly from an upper surface 17 of a base plate 19, is positioned between fixed scroll 10 and crankcase 8. Wraps 12, 18 nest with one another to form a series of moveable crescent-shaped compression pockets 20 between the two scrolls.

A passage 25 may be formed in orbiting scroll 16, putting a lower surface of base plate 19 of orbiting scroll 16 in fluid communication with an area of intermediate pressure $P_i$ of pockets 20, to provide an axial compliance force which biases the tips of spiral wrap 18 against lower surface 11 of fixed scroll 10. A pair of circumferential seals, or sealing elements (not shown), may be positioned between orbiting scroll 16 and crankcase 8, providing an annular cavity therebetween to contain such intermediate pressure fluid which provides such axial compliance force. It is to be appreciated that other means for providing such axial compliance force can be utilized with the present invention. In certain preferred embodiments, separator plate 5 is secured at an outer circumferential edge thereof to top shell 6, forming muffler chamber 14 between top shell 6 and separator plate 5. Suction plenum 35, having a suction pressure $P_s$, is formed in scroll compressor 2 below the separator plate 5. Check valve 7 is positioned on separator plate 5 over discharge port 15 of fixed scroll 10 to resist fluid flow from muffler chamber 14 back to the scrolls upon shut down. Lug 9 is provided on the exterior surface of top shell 6 to facilitate handling of compressor 2.

In operation, a motor 30 rotatably drives a crankshaft 32 having an eccentric pin 34 which extends axially upward from top end 29 of crankshaft 32. Eccentric pin 34 in turn drives orbiting scroll 16 via a slider block 28 and a bushing 27. A rotation prevention mechanism, such as Oldham coupling 36, is positioned between crankcase 8 and orbiting scroll 16, as illustrated, or between fixed scroll 10 and orbiting scroll 16, to prevent rotation of orbiting scroll 16 as it undergoes such orbital motion. Oldham couplings and their operation are well understood by those skilled in the art and, therefore, no further description need be provided here. A fluid, typically refrigerant, is introduced into a low pressure area of pockets 20, typically proximate the radial outer edges of spiral wraps 12, 18. As orbiting scroll 16 orbits, pockets 20 travel spirally inward with progressively decreasing volume, thus compressing the fluid in pockets 20 to progressively higher pressure. The compressed fluid then exits a high pressure area of pockets 20 through discharge port 15 at discharge pressure $P_d$, into chamber 14 via check valve 7. The compressed fluid is then discharged from chamber 14 via outlet 3, which extends through an outer surface of top shell 6. Typically, a closed loop is provided outside compressor 2, returning the fluid at suction pressure $P_s$ to the suction plenum 35 via port 21. This closed loop is typically part of a vapor compression refrigeration system.

Figure 2:
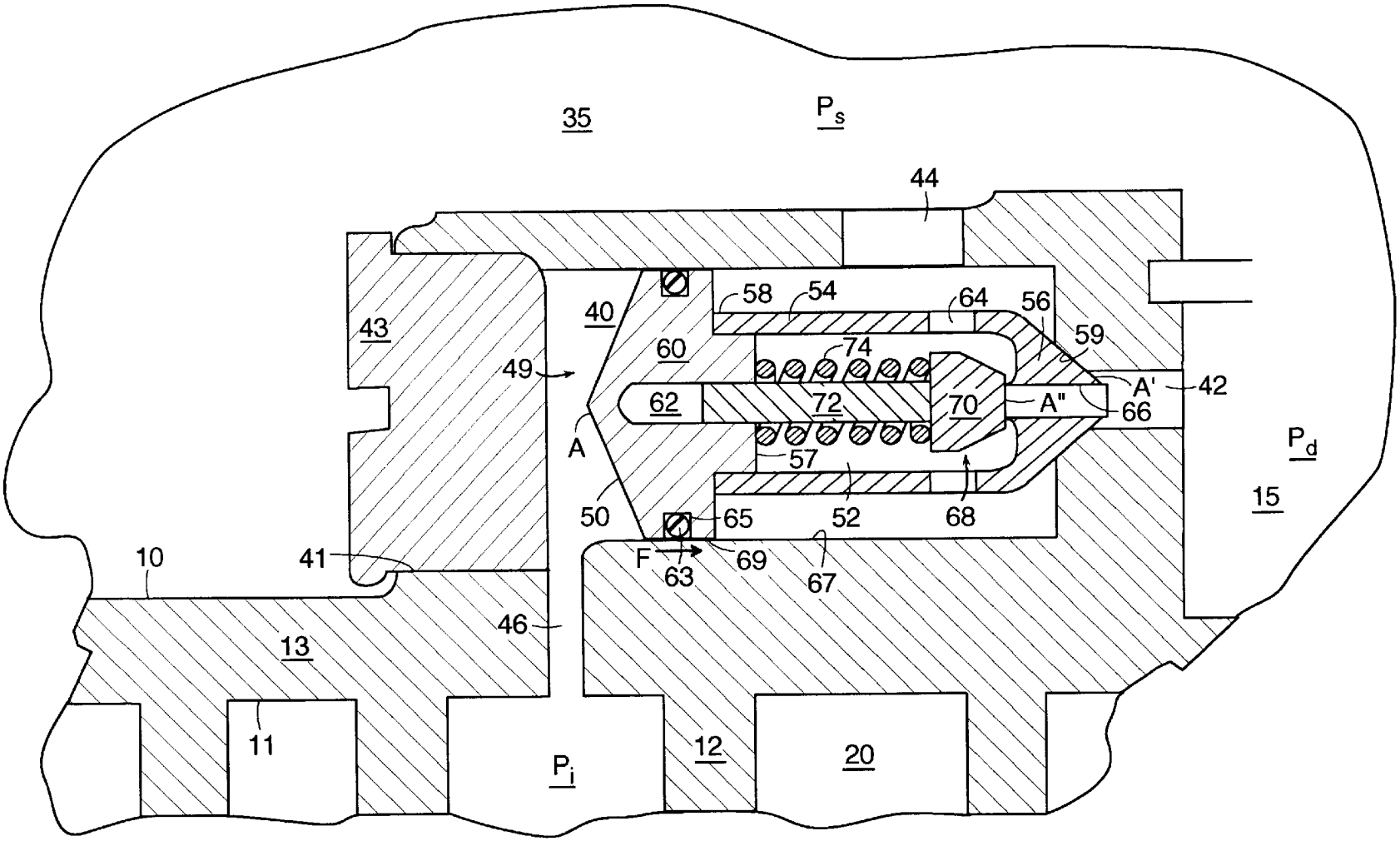
FIG. 2 is a schematic section view, shown partially broken away and enlarged, of the pressure relief valve of the compressor of FIG. 1.

A chamber 40, having an open end 41, is formed in fixed scroll 10, as seen more clearly in FIG. 2. A cover 43 is sealingly secured to fixed scroll 10 at open end 41, by mating threads or other suitable means, to close the open end 41 of chamber 40. Chamber 40 is in fluid communication with and exposed to discharge pressure $p_d$ fluid in discharge port 15 via first passage 42, and suction pressure $P_s$ fluid in suction plenum 35 via second passage 44, and intermediate pressure $P_i$ fluid in pockets 20 via third passage 46. A pressure relief device 49 is housed within chamber 40. Pressure relief device 49 comprises a valve member, such as piston 50, having a cavity 52 formed therein. Piston 50 preferably moves substantially radially with respect to compressor 2 to sealingly engage a first surface 67 of fixed scroll 10 within chamber 40, providing a fluid pressure seal between intermediate pressure Pi fluid and suction plenum 35. A surface of fixed scroll 10, when used here, refers to a surface of the unitary, that is, of one-piece construction, fixed scroll. It is to be appreciated that piston 50, in other preferred embodiments, may move at an inclined angle with respect to the axis of compressor 2.

In a preferred embodiment, piston 50 is formed of cylindrical first portion 54 having a closed first end 56 (with the exception of aperture 66 described below) and an open second end 58. A cap 60, having recess 62 extending axially (relative to piston 50) from an inner surface 57 thereof, is sealingly secured to open end 58. Cap 60 has an exterior surface area A which is exposed to fluid at intermediate pressure $P_i$. A resilient member, such as O-ring 63, is disposed in an annular recess 65 in an outside surface 69 of cap 60. O-ring 63 is positioned between piston 50 and interior surface 67 of chamber 40 and provides a fluid pressure seal between pockets 20, containing intermediate pressure $P_i$ fluid, and chamber 40.

First end 56 of piston 50 releasably sealingly engages a second surface 59 of fixed scroll 10. In the preferred embodiment shown, second surface 59 is a frustro-conical portion of first passage 42 and first end 56 has a corresponding frustro-conical profile. Surface area A' of first end 56 is exposed to fluid at discharge pressure $P_d$. Ports 64 are formed in a sidewall of piston 50 such that cavity 52 is in fluid communication with chamber 40. An aperture 66 is formed in first end 56 of piston 50 such that when first end 56 releasably sealingly engages first passage 42, aperture 66 is coaxial with first passage 42.

A pressure relief valve, such as plunger 68, having a head 70 and a stem 72, is housed within cavity 52. Stem 72 is received by and travels within recess 62 of cap 60 as plunger 68 moves radially (i.e., radially with respect to the overall compressor 2). In a preferred embodiment, plunger 68 and piston 50 are coaxially aligned. Head 70 is biased into releasable sealing engagement with aperture 66 by a biasing member such as spring 74, having a predetermined spring force. An exterior surface area A" of head 70 is exposed to fluid at discharge pressure $P_d$ via aperture 66 and first passage 42. In the illustrated embodiment, spring 74 is a compressed coil spring, biased at one end against an inside surface of cap 60 and at its other end against head 70 of plunger 68.

In operation, piston 50 will pass fluid at discharge pressure $P_d$ from discharge port 15 to suction plenum 35 when the ratio of discharge pressure fluid $P_d$ to suction pressure $P_s$ exceeds a predetermined value. It is presently understood that piston 50 will operate to pass fluid at discharge pressure $P_d$ to suction plenum 35 via first passage 42 and second passage 44 when the ratio of the discharge pressure to the suction pressure exceeds a certain value, specifically, when:

$$P_d/P_s > A/A'[(P_i/P_s)-1]+1+(F/A'P_s),$$

wherein F is a friction force working against piston 50 on interior surface 67 of chamber 40.

It is to be appreciated that the ratio of $P_i/P_s$ is fundamentally a function of the geometry and kinematics of compressor 2 along with the conditions prevailing at any given point in time. In scroll-type compressors, the pressure in the pockets formed by the spiral wraps generally increases from a low value at the outer peripheral edges of the spiral wraps to a high value at their center. $P_i$ is, therefore, determined in large part by the radial position of third passage 46 with respect to spiral wrap 12. In other configurations, passage 46 may communicate alternatively with intermediate and discharge pressures, resulting in a time average value of pressure $\overline{P}_i$ in passage 46, where:

$$P_d > \overline{P}_i > P_s$$

In the preferred embodiment shown, plunger 68 will pass fluid at discharge pressure $P_d$ from discharge port 15 to suction plenum 35 via first passage 42, aperture 66, ports 64, and second passage 44, whenever $[P_d - P_s]A''$ exceeds the predetermined spring force of spring 74. Therefore, plunger 68 responds to and relieves an excess differential pressure of compressor 2.

It is to be appreciated that this device will also unload compressor 2 whenever $P_s > P_d$, such as during a condition of reverse rotation, by passing fluid from suction plenum 35 to discharge port 15.

Figure 3:
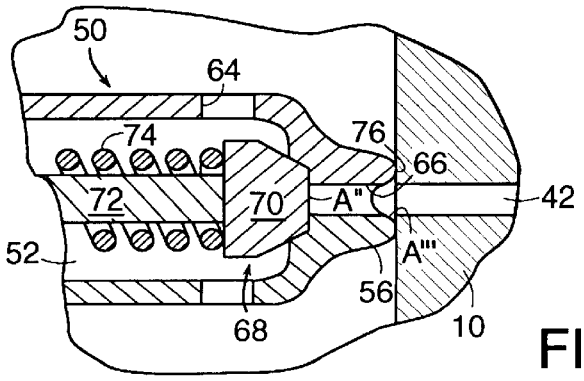
FIG. 3 is a schematic section view, shown partially broken away and enlarged, of an alternative embodiment of the pressure relief valve of FIG. 2.

Another preferred embodiment of piston 50 is shown in FIG. 3. In this embodiment, first passage 42 extends through fixed scroll 10 with no countersunk portion. First end 56 has a raised annular portion 76, creating a recessed surface area A''' which is exposed to fluid at discharge pressure $P_d$ through first passage 42. Annular portion 76 contacts and sealingly engages fixed scroll 10 about first passage 42. This embodiment works in the same manner as the embodiment described above to relieve excess pressure ratios and pressure differentials.

It is to be appreciated that scroll compressor 2 may be equipped with a passage and/or suitable conduit (not shown) to pass discharge gas, in the event of high pressure differentials or ratios, to an area proximate motor 30. Such gasses have elevated temperatures which allow a high temperature sensing shutoff device or motor protector (not shown) to shut down the compressor motor under such conditions. Such high temperature sensing devices are well known to those skilled in the art, and further description here is not needed.

In light of the foregoing disclosure of the invention and description of the preferred embodiments, those skilled in this area of technology will readily understand that various modifications and adaptations can be made without departing from the true scope and spirit of the invention. All such modifications and adaptations are intended to be covered by the following claims.

What is claimed is:

1. A scroll-type machine comprising, in combination:

a housing defining a suction plenum;

an orbiting scroll positioned within the housing and having a spiral wrap;

a fixed scroll mounted within the housing and having a spiral wrap nested with the spiral wrap of the orbiting scroll to form pockets between the wraps for progressively compressing fluid from the suction plenum at suction pressure through intermediate pressure to a discharge pressure at a discharge port formed in the fixed scroll, a chamber formed within the fixed scroll, a first passage formed in the fixed scroll from the discharge port to the chamber, a second passage formed in the fixed scroll from the chamber to the suction plenum, and a third passage formed in the fixed scroll from the chamber to the pockets; and a pressure relief device in the chamber in the fixed scroll, sealingly engaging a first surface of the fixed scroll to form a fluid pressure seal at all times within the chamber between the second passage and the third passage, and releasably sealingly engageable to a second surface of the fixed scroll to form a releasable fluid pressure seal within the chamber between the first passage and the second passage.

2. The scroll-type machine according to claim 1, wherein the pressure relief device is adapted to pass fluid from the first passage to the second passage when the ratio of fluid pressure in the first passage to fluid pressure in the second passage exceeds a predetermined value.

3. The scroll-type machine according to claim 1, wherein the pressure relief device is adapted to pass fluid from the first passage to the second passage when the difference between fluid pressure in the first passage and fluid pressure in the second passage exceeds a predetermined value.

4. A scroll-type machine comprising, in combination:

a housing defining a suction plenum for containing fluid at a suction pressure;

an orbiting scroll positioned within the housing and having a spiral wrap;

a fixed scroll mounted within the housing, having a spiral wrap nested with the spiral wrap of the orbiting scroll forming pockets therebetween for containing intermediate pressure fluid, a discharge port for passing fluid at a discharge pressure, and a chamber formed therein exposed to the discharge port, the suction plenum, and the pockets; and a pressure relief device housed within the chamber in sealing engagement with a first surface of the fixed scroll providing a seal at all times between the pockets and the suction plenum, and in releasable sealing engagement with a second surface of the fixed scroll providing a releasable seal between the discharge port and the suction plenum, the pressure relief device adapted to pass fluid from the discharge port to the suction plenum when the ratio of the discharge pressure to the suction pressure exceeds a predetermined value.

5. The scroll-type machine according to claim 4, wherein the pressure relief device passes fluid to the suction plenum when a difference between the discharge pressure and the suction pressure exceeds a predetermined value.

6. The scroll-type machine according to claim 4, wherein the fixed scroll has a first passage providing fluid communication between the discharge port and the chamber, a second passage providing fluid communication between the suction plenum and the chamber, and a third passage providing fluid communication between the pockets and the chamber.

7. The scroll-type machine according to claim 6, wherein the pressure relief device comprises a piston.

8. The scroll-type machine according to claim 7, wherein the second surface of the fixed scroll is a surface of the first passage, and the releasable seal between the discharge port and the suction plenum is formed by a first end surface of the piston releasably engaging a surface of the first passage.

9. The scroll-type machine according to claim 7, wherein the piston has a cavity formed therein housing a pressure relief valve, and a port providing fluid communication between the chamber and the cavity.

10. The scroll-type machine according to claim 9, wherein the pressure relief valve comprises a plunger biased into releasable sealing engagement with an aperture formed in a first end of the piston.

11. The scroll-type machine according to claim 10, wherein the plunger is biased into releasable sealing engagement with the aperture via a spring.

12. The scroll-type machine according to claim 10, wherein the plunger and the piston are coaxial and move in a substantially radial direction with respect to the scroll-type machine.

13. The scroll-type machine according to claim 7, wherein the first passage has a frustro-conical portion proximate the chamber and the first end of the piston is correspondingly frustro-conical to matingly and releasably sealingly engage the frustro-conical portion of the first passage.

14. The scroll-type machine according to claim 7, wherein a first end of the piston has a raised annular portion which releasably sealingly engages the fixed scroll about the first passage.

15. The scroll-type machine according to claim 4, wherein a resilient member provides the sealing engagement with the first surface.

16. The scroll-type machine according to claim 15, wherein the resilient member comprises an O-ring.

17. A scroll-type machine comprising, in combination:

a fixed scroll mounted within a housing, having a spiral wrap, a chamber formed therein, and a discharge port for passing fluid at a discharge pressure;

an orbiting scroll having a spiral wrap nested with the spiral wrap of the fixed scroll forming pockets therebetween for containing fluid at an intermediate pressure;

a suction plenum for containing fluid at a suction pressure; and a pressure relief device housed within the chamber and adapted to pass fluid from the discharge port to the suction plenum when a difference between the discharge pressure and the suction pressure exceeds a predetermined value and when the ratio of the discharge pressure to the suction pressure exceeds a predetermined value.

18. The scroll-type machine according to claim 17, wherein the pressure relief device comprises:

a piston having a cavity formed therein and a first end exposed to the discharge port, a second end exposed to the pockets, a first aperture formed in the first end thereof, a port formed in an exterior surface thereof, the cavity being in fluid communication with the suction plenum via the port and with the discharge port via the first aperture;

a plunger housed within the cavity;

a biasing member positioned between the plunger and a surface of the cavity, the biasing member adapted to bias the plunger against and releasably sealingly engage the first aperture.

19. The scroll-type machine according to claim 18, wherein the piston passes fluid to the suction plenum when the ratio of the discharge pressure to the suction pressure exceeds a predetermined value; and the plunger passes fluid to the suction plenum when a difference between the discharge pressure and the suction pressure exceeds a predetermined value.

20. The scroll-type machine according to claim 18, wherein the fixed scroll has a first passage providing fluid communication between the discharge port and the chamber, a second passage providing fluid communication between the suction plenum and the chamber, and a third passage providing fluid communication between the pockets and the chamber.

21. The scroll-type machine according to claim 20, wherein the piston provides a seal between the pockets and the chamber, and a releasable seal between the discharge port and the chamber.

22. The scroll-type machine according to claim 21, wherein the seal between the discharge port and the chamber is formed by the first end of the piston releasably sealingly engaging the first passage.

23. The scroll-type machine according to claim 21, wherein a resilient member disposed between the piston and an interior surface of the chamber forms the seal between the pockets and the chamber.

24. The scroll-type machine according to claim 23, wherein the resilient member comprises an O-ring.

25. The scroll-type machine according to claim 18, wherein the biasing member comprises a spring.

26. A compressor comprising, in combination:

a housing defining a suction plenum;

a first scroll member positioned within the housing;

a second scroll member positioned within the housing and intermeshed with the first scroll member to form pockets between the wraps for progressively compressing fluid from the suction plenum at suction pressure through intermediate pressure to a discharge pressure at a discharge port formed in the first scroll member;

a chamber formed within the first scroll member;

a first passage formed in the first scroll member from the discharge port to the chamber;

a second passage formed in the first scroll member from the chamber to the suction plenum;

a third passage formed in the first scroll member from the chamber to the pockets; and a pressure relief device in the chamber in the first scroll member, sealingly engaging a first surface of the first scroll member to form a fluid pressure seal at all times within the chamber between the second passage and the third passage, and releasably sealingly engageable to a second surface of the first scroll member to form a releasable fluid pressure seal within the chamber between the first passage and the second passage, the pressure relief device being adapted to pass fluid from the first passage to the second passage when the ratio of fluid pressure in the first passage to fluid pressure in the second passage exceeds a predetermined value.

27. The compressor according to claim 26, wherein the pressure relief device is adapted to pass fluid from the first passage to the second passage when the difference between fluid pressure in the first passage and fluid pressure in the second passage exceeds a predetermined value.

28. A scroll-type machine comprising, in combination:

an orbiting scroll contained within a housing and having a spiral wrap;

a fixed scroll mounted within the housing, comprising:

a spiral wrap nested with the spiral wrap of the orbiting scroll forming pockets therebetween, a chamber formed therein, a discharge port, a first passage providing fluid communication between the discharge port and the chamber, a second passage providing fluid communication between a suction plenum and the chamber, and a third passage providing fluid communication between the pockets and the chamber; and a pressure relief device housed within the chamber in sealing engagement with a first surface of the fixed scroll providing a seal at all times between the pockets and the suction plenum, and in releasable sealing engagement with a second surface of the fixed scroll providing a seal between the discharge port and the suction plenum, the pressure relief device adapted to pass fluid from the discharge port to the suction plenum when the ratio of a discharge pressure to a suction pressure exceeds a predetermined value and to pass fluid from the discharge port to the suction plenum when the difference between the discharge pressure and the suction pressure exceeds a predetermined value.

29. A scroll-type machine comprising, in combination:

a housing defining a suction plenum;

an orbiting scroll positioned within the housing and having a spiral wrap;

a fixed scroll mounted within the housing and having a spiral wrap nested with the spiral wrap of the orbiting scroll forming pockets therebetween, a chamber formed therein in fluid communication with a discharge port formed in the fixed scroll, the suction plenum, and the pockets; and a pressure relief device housed within the chamber operating in a radial direction with respect to the scroll-type machine to pass fluid from the discharge port to the suction plenum when the ratio of a discharge pressure to a suction pressure exceeds a predetermined value.

30. The scroll-type machine according to claim 29, wherein the pressure relief device operates to pass fluid from the discharge port to the suction plenum when the difference between a discharge pressure and a suction pressure exceeds a predetermined value.

* * * * *